US006765374B1

(12) United States Patent
Yang et al.

(10) Patent No.: US 6,765,374 B1
(45) Date of Patent: Jul. 20, 2004

(54) LOW DROP-OUT REGULATOR AND AN POLE-ZERO CANCELLATION METHOD FOR THE SAME

(75) Inventors: Ta-yung Yang, Milpitas, CA (US); Hsuan-I Pan, Taipei (TW); Chern-Lin Chen, Taipei (TW); Jenn-yu G. Lin, Taipei (TW)

(73) Assignee: System General Corp., Taipei Hsien (TW)

( * ) Notice: Subject to any disclaimer, the term of this patent is extended or adjusted under 35 U.S.C. 154(b) by 0 days.

(21) Appl. No.: 10/617,951

(22) Filed: Jul. 10, 2003

(51) Int. Cl.[7] ..... G05F 1/56
(52) U.S. Cl. ..... 323/280
(58) Field of Search ..... 323/273, 280, 323/281, 349

(56) References Cited

U.S. PATENT DOCUMENTS 6,300,749 B1 * 10/2001 Castelli et al. ..... 323/273
6,373,233 B2 * 4/2002 Bakker et al. ..... 323/282
6,518,737 B1 * 2/2003 Stanescu et al. ..... 323/280
6,522,112 B1 * 2/2003 Schmoock et al. ..... 323/280
6,600,299 B2 * 7/2003 Xi ..... 323/280
6,603,292 B1 * 8/2003 Schouten et al. ..... 323/277
6,703,816 B2 * 3/2004 Biagi et al. ..... 323/280
6,710,583 B2 * 3/2004 Stanescu et al. ..... 323/280

* cited by examiner

*Primary Examiner*—Adolf Berhane
(74) *Attorney, Agent, or Firm*—J.C. Patents

(57) ABSTRACT

A method an apparatus to dynamically modify the internal compensation of a low drop-out (LDO) linear voltage regulator is presented. The process involves creating an additional equivalent series resistance (ESR) from an internal circuit. The additional ESR of the internal circuit is sufficient to ensure DC output stability. This allows the ESR of the output capacitance to be reduced to zero if desired, for improved transient response. The zero induced by the ESR of the internal circuit is frequency compensated, so that it tracks the position of the output pole as the load varies.

15 Claims, 7 Drawing Sheets

LOW DROP-OUT REGULATOR AND AN POLE-ZERO CANCELLATION METHOD FOR THE SAME

BACKGROUND OF THE INVENTION

1. Field of the Invention

The present invention relates to a voltage regulator circuit, and more particularly to a low drop-out regulator and an adaptive frequency compensation method for the same.

2. Description of the Related Art

Voltage regulators with a low drop-out (LDO) are commonly used in the power management systems of PC motherboards, notebook computers, mobile phones, and many other products. Power management systems use LDO regulators as local power supplies, where a clean output and a fast transient response are required. LDO regulators enable power management systems to efficiently supply additional voltage levels the are smaller than the main supply voltage. For example, the 5V power systems of many PC motherboards use LDO regulators to supply local chipsets with a clean 3.3V signal.

Although LDO regulators do not convert power very efficiently, they are inexpensive, small, and generate very little frequency interference. Furthermore, LDO regulators can provide a local circuit with a clean voltage that is unaffected by current fluctuations from other areas of the power system. LDO regulators are widely used to supply power to local circuits when the power consumption of the local circuit is negligible with respect to the overall load of a power system.

An ideal LDO regulator should provide a precise DC output, while responding quickly to load changes and input transients. Due to the nature of its use in mass-produced products such as computers and mobile phones, LDO regulators should also have a simple design and a low production cost.

A typical LDO regulator consists of a feedback-control loop coupled to a pass element. The feedback-control loop modulates the gate voltage of the pass element to control its impedance. Depending on the gate voltage, the pass element supplies different levels of current to an output section of the power supply. The modulation of the gate voltage is done in a manner such that the LDO regulator outputs a steady DC voltage, regardless of load conditions and input transients.

One problem with traditional LDO circuits is that they are prone to instability. The output section of a traditional LDO circuit includes an output capacitor coupled to the load. This coupling introduces a dominant pole into the feedback circuit. Traditional LDO circuits rely on the equivalent series resistance (ESR) of the output capacitor to restore stability. Within a narrow range of values, the ESR can compensate for the output pole by introducing a zero into the LDO regulator feedback-control loop. Within a range of operating conditions, the zero can increase the phase margin of the LDO regulator.

Unfortunately, the ESR is a parasitic component of the output capacitor and its value cannot easily be determined or controlled to a high precision. The ESR of a capacitor changes significantly with respect to load, temperature, and possibly other factors. If the ESR increases or decreases too much, then the ESR zero will no longer compensate for the pole introduced by the output capacitor.

Another problem with traditional LDO regulators is that the ESR adversely affects the transient response of the LDO regulator. For a LDO regulator to respond rapidly to transients, the ESR must be reduced as much as possible. However, a small ESR will shift the compensating zero of the ESR to a higher frequency, where it will no longer compensate for the pole induced by the output capacitor. In a traditional LDO regulator, the ESR cannot be reduced without threatening the stability of the entire circuit.

Another problem with traditional LDO regulators is that they have a slow transient response under light loads. Under light loads, the frequency of the output capacitor pole decreases. However, the frequency of the stabilizing zero does not change, and the cross-over frequency of the LDO regulator is reduced. Traditional LDO regulators are not designed to enable the stabilizing zero to follow the output pole. If the position of the zero could also be shifted to a lower frequency, the cross-over frequency of the LDO regulator would not be reduced under light loads.

Traditional LDO regulators are prone to instability since the ESR cannot be controlled precisely. Furthermore, their performance suffers degradation under light load conditions. Therefore, there is a need for an improved low drop-out voltage regulator that is suitable for a wider range of capacitive loads while eliminating the minimum ESR restriction of the output capacitor.

SUMMARY OF THE INVENTION

An objective of the present invention is to provide a low dropout (LDO) voltage regulator that can provide DC-DC conversion with very tight output control for computer motherboards, notebook computers, mobile phones, and other products.

Another objective of the present invention is to provide an adaptive frequency compensation scheme for a LDO regulator, such that the LDO regulator is stable under a wide range of load conditions.

Another objective of the present invention is to provide a LDO regulator with generally improved transient response.

Another objective of the present invention is to provide a LDO regulator with a faster transient response under light-load conditions.

According to one aspect of the present invention, to improve stability, the adaptive frequency compensation scheme generates an equivalent series resistance (ESR). This introduces a zero into the feedback loop. The frequency of the generated zero can be controlled precisely. According to the present invention, it is possible to ensure circuit stability without controlling the lower limit of the equivalent series resistance (ESR) of the output capacitor. This is preferable, because the ESR of a capacitor can vary unpredictably with respect to temperature and load.

According to another aspect of the present invention, for a DC output during transient-state operation, the output ESR should be low, and the cross-over frequency of the LDO regulator should be high. The adaptive frequency compensation scheme of the present invention ensures the stability of the LDO regulator with a generated ESR, rather than the ESR of the output capacitance. There is no need to control lower limit of the ESR of the output capacitance. According to the present invention, the output section can contain an arbitrarily low capacitive ESR without endangering system stability. In practice, this enables the LDO regulator to be optimized for improved transient performance.

According to yet another aspect of the present invention, the adaptive frequency compensation scheme provides for a low-power mode of operation. In low-power mode, pole-zero tracking is enabled. Pole-zero tracking adjusts the position of the zero induced by the generated ESR, so that the zero follows the decrease in the frequency of the output pole. Adjusting the frequency of the zero in this manner maintains the cross-over frequency of the system under light loads. Thus, the transient response of the LDO regulator according to the present invention does not suffer degradation under light loads.

Still further objects and advantages will become apparent from a consideration of the ensuing description and drawings,

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
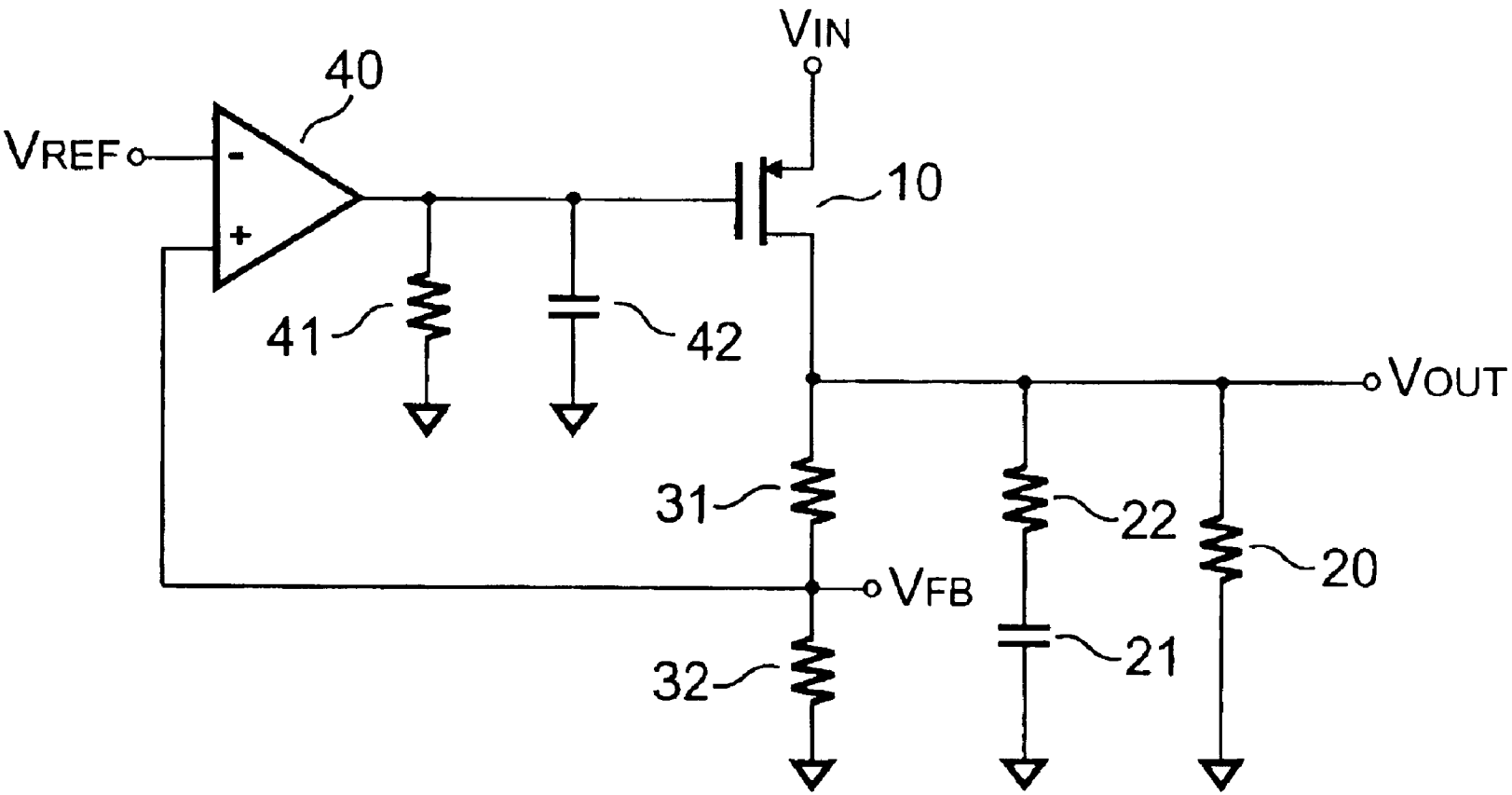
FIG. 1 (Prior Art)
FIG. 1 shows a prior-art LDO regulator.

Referring now to the drawings wherein the contents are for purposes of illustrating the preferred embodiment of the invention only and not for purposes of limiting same, FIG. 1 shows a basic configuration of a prior-art low drop-out (LDO) regulator.

The prior-art regulator includes an unregulated DC input port $V_{IN}$, an output pass transistor 10, a regulated DC output port $V_{OUT}$, and an output section comprising a load resistance 20, an output capacitor 21 and a parasitic equivalent series resistance (ESR) 22. The prior-art regulator further comprises a voltage divider having a voltage divider point $V_{FB}$, a resistor 31 and a resistor 32. The prior-art regulator further comprises a feedback-control circuit. The feedback-control circuit comprises an error amplifier 40, a reference voltage port $V_{REF}$. The output impedance of the error amplifier 40 is represented as a resistor 41, which is connected from an output of the error amplifier 40 to the ground reference. A gate of the output pass transistor 10 has a parasitic capacitance represented as a capacitor 42, which is connected from the gate of the output pass transistor 10 to the ground reference.

The unregulated DC input port $V_{IN}$ is connected to a source of the output pass transistor 10. A drain of the output pass transistor 10 is connected to the regulated DC output port $V_{OUT}$. The load resistance 20 and the output capacitor 21 are connected in parallel between the regulated DC output port $V_{OUT}$ and the ground reference. The output capacitor 21 includes a parasitic ESR 22.

The unregulated DC output port $V_{OUT}$ is connected to the feedback-control circuit through the voltage divider. The resistor 31 and the resistor 32 are connected in series between the regulated DC output port $V_{OUT}$ and the ground reference. The voltage divider point $V_{FB}$ is in between the resistor 31 and the resistor 32. The voltage divider point $V_{FB}$ is connected back to a positive input of the error amplifier 40. The reference voltage point $V_{REF}$ is connected to a negative input of the error amplifier 40. An output of the error amplifier 40 is connected to a gate of the output pass transistor 10. Operation of this circuit will be well known to those skilled in the art.

Figure 5:
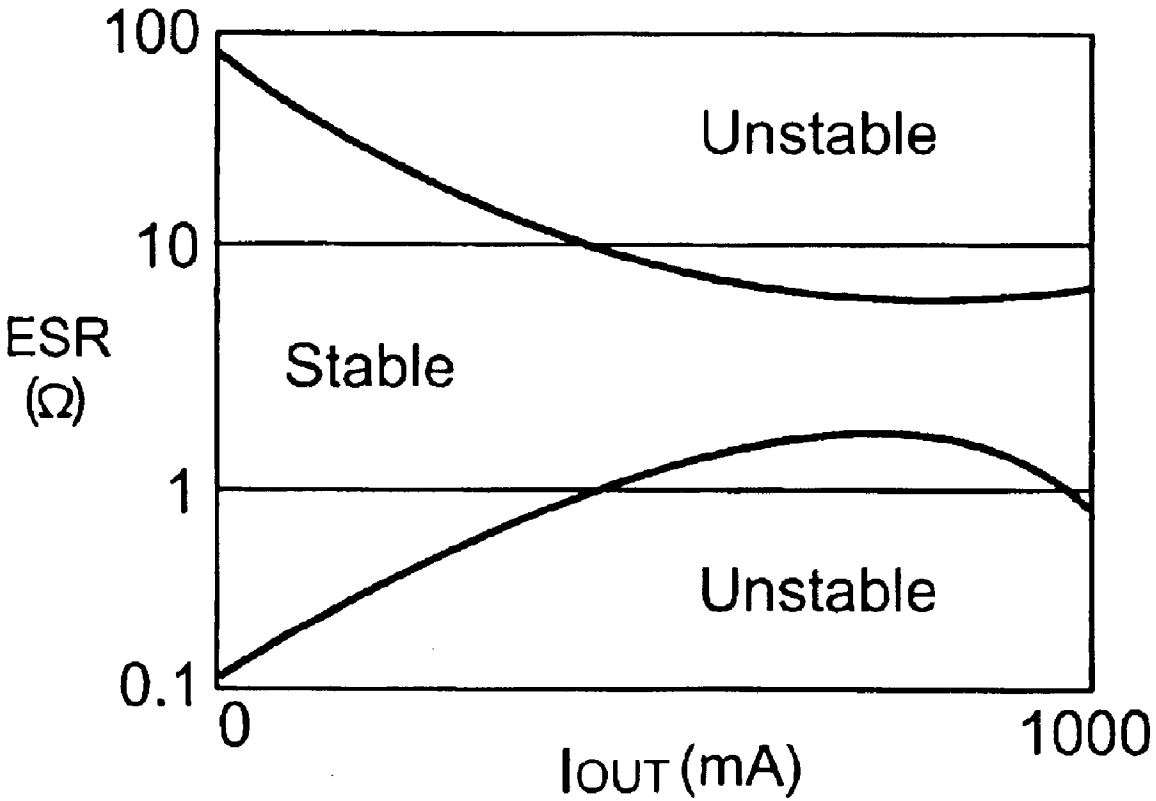
FIG. 5 ( Prior Art)
FIG. 5 is a graph showing the approximate range of ESR values that guarantee the stability of the prior-art LDO regulator.

As discussed, the prior-art circuit is prone to instability. If the slope at the cross-over frequency becomes less than −40 dB per decade, the system will be unstable. The stability of the circuit depends on the zero introduced by the parasitic ESR 22 of the output capacitor 21. However, the magnitude of the parasitic resistance can vary greatly with respect to small changes in the operating conditions of the circuit (load, temperature, etc). This can change the position of the zero, and cause the circuit to become unstable. FIG. 5 shows the range of values for the ESR that guarantee stability, for a typical prior-art LDO regulator. It is important to notice that this range changes significantly with respect to the load current.

Figure 6A:
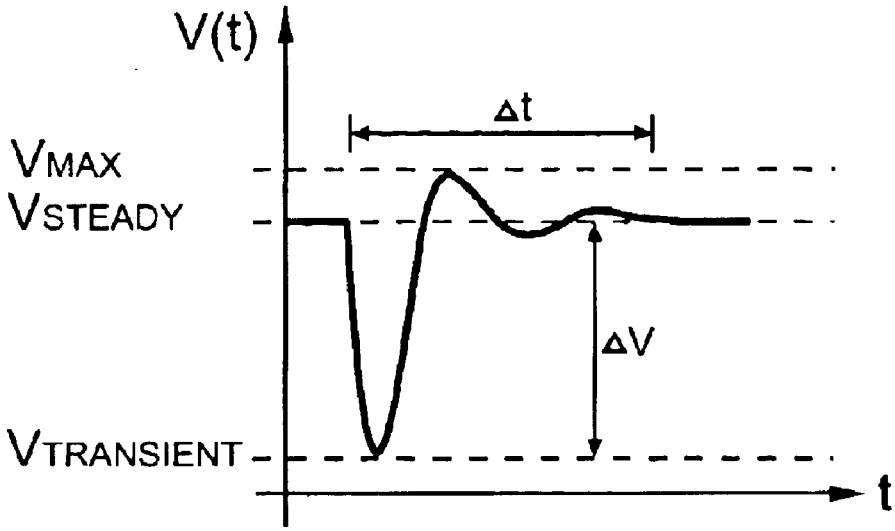
FIG. 6A (Prior Art)
FIG. 6A shows the transient response of the prior-art LDO regulator.

Even if a stable ESR could be provided, it would adversely affect the transient performance of the circuit. FIG. 6A illustrates the effect of the ESR on the transient response of the LDO regulator. During load changes, a high ESR will result in a less precise DC output. The higher the output ESR is, the higher the voltage drop $\Delta V$ will be resulted.

Figure 2:
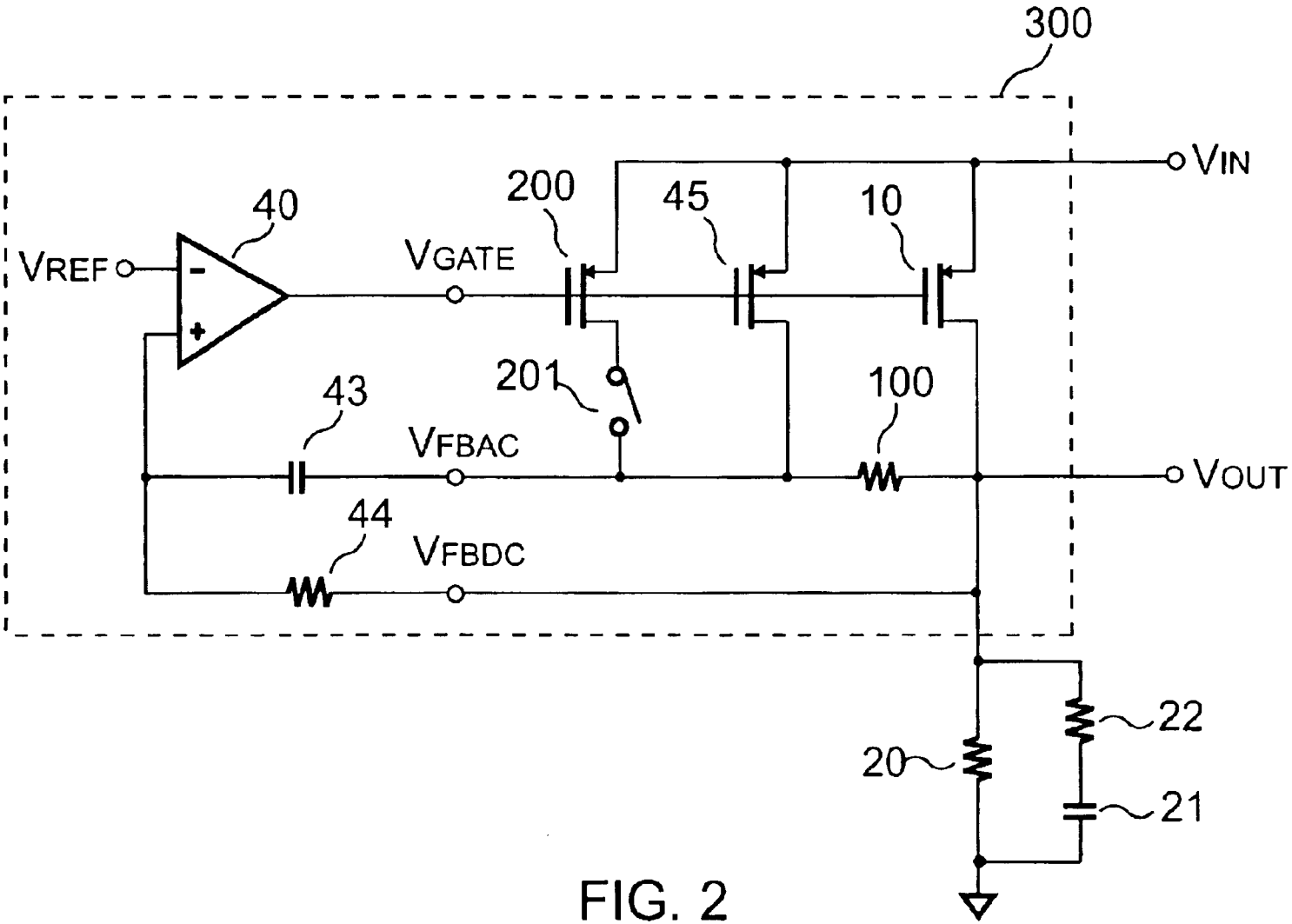
FIG. 2 shows a LDO regulator according to the present invention.

FIG. 2 illustrates the basic scheme of a LDO voltage regulator circuit 300 according to the present invention. Details of the reference voltage supply circuit (which may be entirely conventional) have been omitted for simplicity. Like reference numerals are used where components correspond to those of the prior art arrangements described above. It will be seen that the illustrated circuit may be regarded as conventional in so far as it comprises an error amplifier 40 supplying a gate voltage to a gate signal terminal $V_{GATE}$. The gate signal terminal $V_{GATE}$ controls a gate of a P-MOSFET based output pass transistor 10. A reference voltage $V_{REF}$ is supplied to a negative input of the error amplifier 40. When turned on, the output pass transistor 10 supplies power from an unregulated DC input port $V_{IN}$ to a regulated DC output port $V_{OUT}$. A load resistance 20 and an output capacitor 21 having a parasitic ESR 22 are connected in parallel from the DC output port $V_{OUT}$ to the ground reference.

The feedback-control circuit of the present LDO regulator is substantially different from that of standard LDO regulators. To supply a feedback signal to the error amplifier 40, the feedback-control circuit according to the present invention includes an AC feedback terminal $V_{FBAC}$ and a DC feedback terminal $V_{FBDC}$. A source of a transistor 45 is connected to the unregulated DC input port $V_{IN}$. A gate of the transistor 45 is connected to the gate signal terminal $V_{GATE}$. A drain of the transistor 45 is connected to the AC feedback terminal $V_{FBAC}$. The AC feedback terminal $V_{FBAC}$ is connected to a positive input of the error amplifier 40 via a capacitor 43. The DC feedback terminal $V_{FBDC}$ is connected from the regulated DC output port $V_{OUT}$ to the positive input of the error amplifier 40 via a resistor 44. The DC feedback terminal $V_{FBDC}$ is equivalent to the regulated DC output port $V_{OUT}$.

The LDO regulator according to the present invention further differs from prior-art LDO regulators, in that in place of relying upon the parasitic ESR 22 to provide a zero, the circuit includes a stabilizing-zero resistor 100. The stabilizing-zero resistor 100 is connected between the regulated DC output port $V_{OUT}$ and the AC feedback terminal $V_{FBAC}$. This introduces a stabilizing zero into the transfer function that depends on the resistance of the stabilizing-zero resistor 100, instead of depending on the parasitic ESR 22 according to the prior-art. Because the resistance of the stabilizing-zero resistor 100 can be precisely controlled, it is no longer necessary to depend on the parasitic ESR 22 for the stability of the transfer function.

Figure 6B:
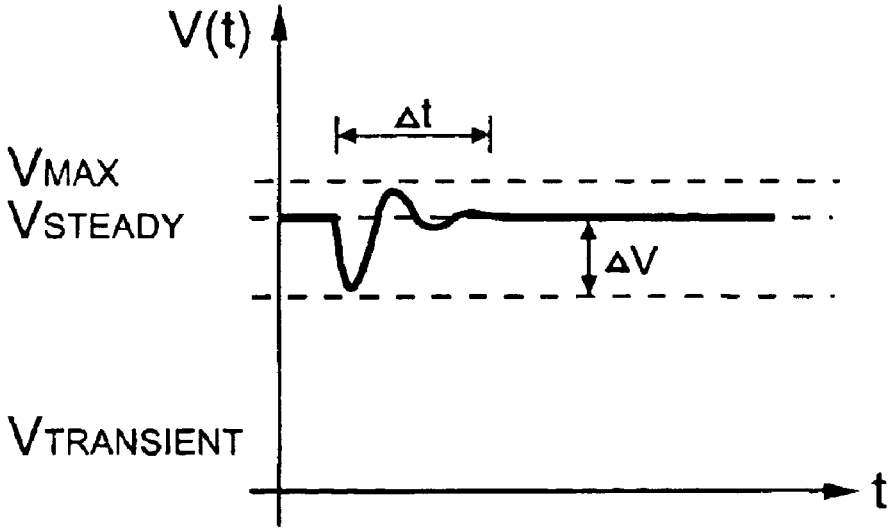
FIG. 6B shows the transient response of the LDO regulator according to the present invention.

Prior-art regulators generally require a minimum value for the ESR of the output capacitor 21. This stabilizes the circuit, but it also adversely affects the transient response (FIG. 6A). During load changes, a high ESR will result in a larger deviation from the steady-state DC output voltage. In the LDO regulator according to the present invention, the parasitic ESR 22 can be reduced arbitrarily without endangering system stability. Because of this, it is possible to improve the transient response of the LDO regulator by using a capacitor with a very low ESR for the output capacitor 21. This allows the LDO regulator to be optimized for improved transient response, so that the deviation $\Delta V$ from the output voltage will be reduced (FIG. 6B).

The feedback circuit of the present invention takes a high-frequency feedback signal from the point $V_{FBAC}$. The capacitor 43 is necessary as a DC blocking device, because $V_{FBAC}$ cannot be used to determine the output voltage $V_{OUT}$. This is because a small current will flow across the stabilizing-zero resistor 100. This current will change with respect to the magnitude of the output load. As this current changes with respect to output load, the potential drop across the stabilizing-zero resistor 100 will also change.

Therefore, it is necessary to include a DC feedback terminal $V_{FBDC}$ to supply the DC component of the feedback signal to the error amplifier 40. The DC feedback voltage is supplied to the positive input of the error amplifier 40 via the resistor 44. If the resistance of the resistor 44 is sufficiently large, it will prevent the high-frequency behavior of the LDO from being affected. A typical value for the resistance of the resistor 44 would be about 10 MΩ.

Figure 7A:
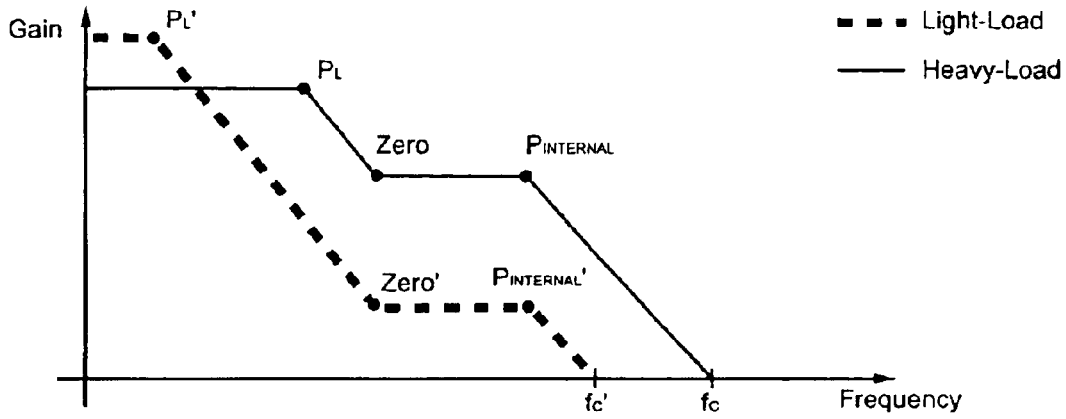
FIG. 7A (Prior Art)
FIG. 7A compares the pole-zero locations and cross-over frequencies of the transfer function of the prior-art LDO regulator. The solid line indicates the transfer function under a heavy-load and the dotted line indicates the transfer function under a light-load.

The transient response of the prior-art LDO regulator deteriorates under light loads. This happens because the frequency of the dominant pole decreases. However, the frequency of the stabilizing zero introduced by the parasitic ESR 22 does not change. This reduces the cross-over frequency, and with that, the transient response of the circuit. FIG. 7A demonstrates this effect, where the solid-line shows the frequency response under heavy-loads, and the dotted-line indicates the frequency response under light-loads. Because the cross-over frequency decreases from $f_c$ to $f_c'$ under light-loads, the transient response of the LDO regulator slows down. When load changes occur, the output of the LDO regulator takes more time $\Delta t$ to adjust (FIG. 6A).

Figure 7B:
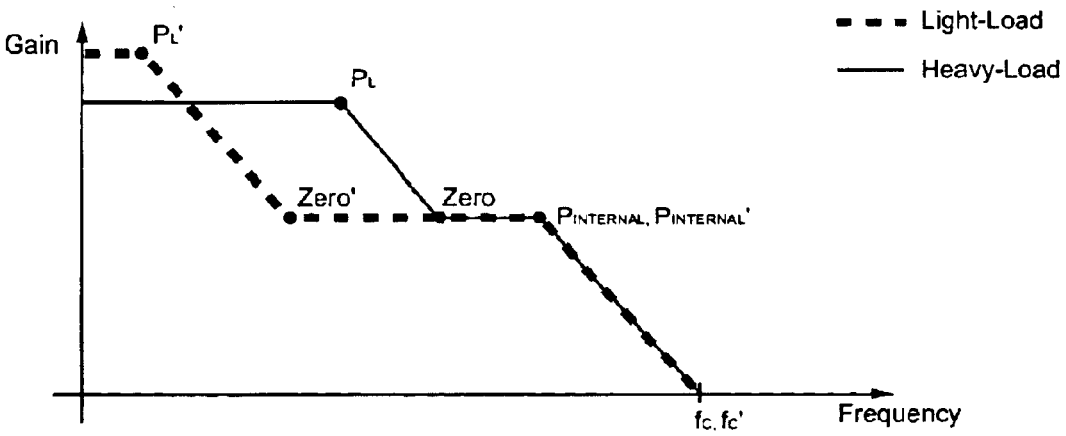
FIG. 7B compares the pole-zero locations and cross-over frequencies of the transfer function of the LDO regulator according to the present invention. The solid line indicates the transfer function under a heavy-load and the dotted line indicates the transfer function under a light-load.

To avoid degradation to the transient response under light-load conditions, the LDO regulator according to the present invention includes a pole-zero tracking circuit. The pole-zero tracking circuit offers a means of adaptive frequency compensation for the zero introduced by the stabilizing-zero resistor 100. The pole-zero tracking circuit changes the Bode-plot while maintaining DC stability. FIG. 7B demonstrates the effect of the pole-zero tracking circuit, where the solid-line shows the frequency response under heavy-loads, and the dotted-line indicates the frequency response under light-loads. Because the cross-over frequency ($f_c$, $f_c'$) does not change under light-load conditions, the transient response of the LDO regulator does not suffer degradation. FIG. 6B shows that the time $\Delta t$ required for the LDO regulator output voltage to stabilize is substantially shorter than that in the prior-art.

The pole-zero tracking circuit comprises a transistor 200 and a switch 201. A gate of the transistor 200 is connected to the gate signal terminal $V_{GATE}$. A source of the transistor 200 is connected to the unregulated DC input port $V_{IN}$. A drain of the transistor 200 is connected to the AC feedback terminal $V_{FBAC}$ via the switch 201.

The gate signal terminal $V_{GATE}$ drives the gates of the transistor 200 and the transistor 45. Therefore, the current flowing from the source to the drain of the transistor 45 will be proportional to the current flowing from the source to the drain of the transistor 200. The physical dimensions of the transistor 200 and the transistor 45 determine the ratio of the currents. Thus, when the switch 201 opens, this discrete feedback signal modulation scheme will decrease the feedback current flowing from the unregulated voltage input $V_{IN}$ to the AC feedback point $V_{FBAC}$. The switch 201 is included so that the LDO regulator according to the present invention has two modes of operation. When the output load of the LDO regulator decreases, the switch 201 automatically closes. When the output load of the LDO regulator increases, the switch 201 automatically opens. When the switch 201 closes, it allows more current to flow from the unregulated DC input port $V_{IN}$ to the AC feedback terminal $V_{FBAC}$.

Figure 3:
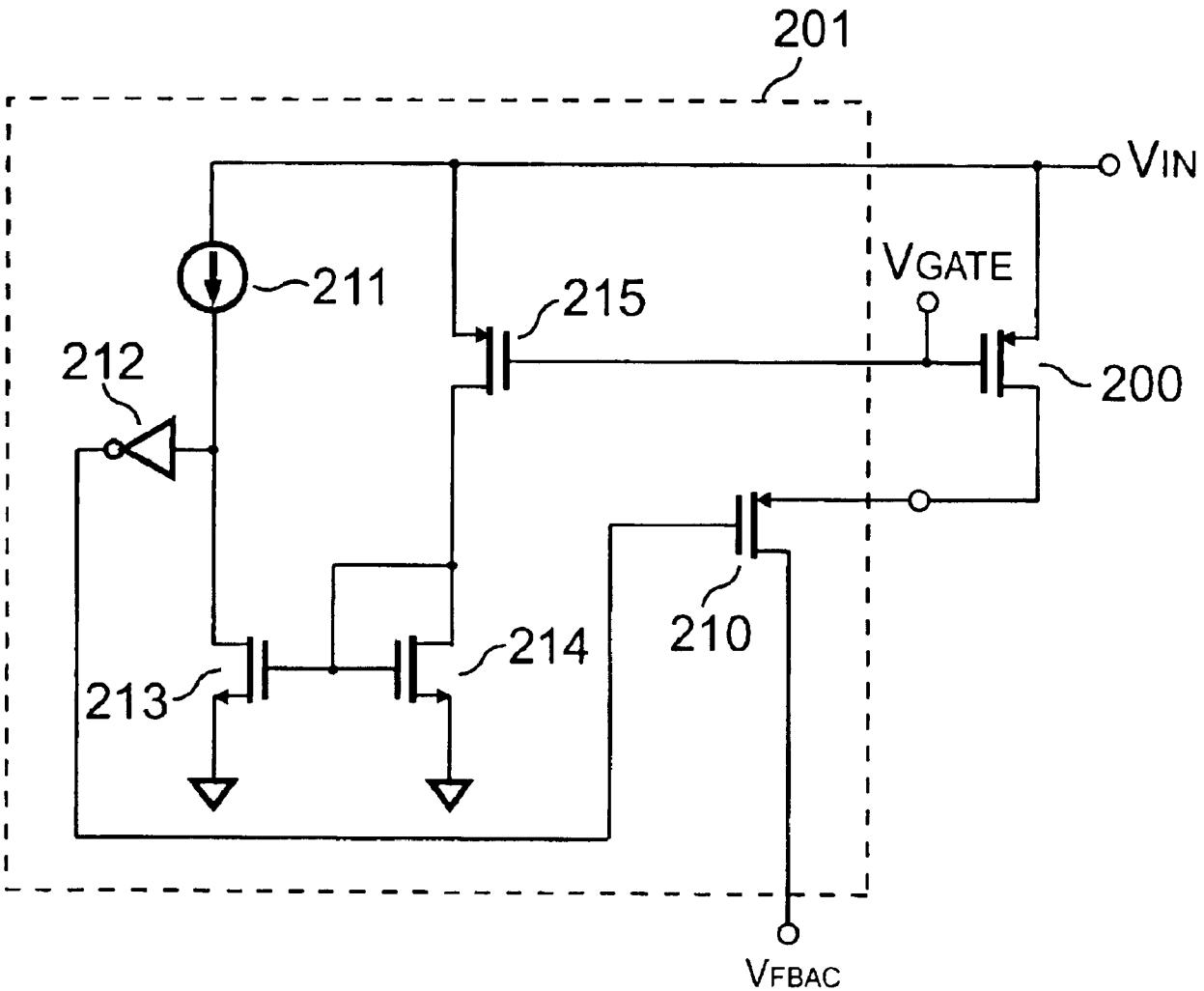
FIG. 3 shows an embodiment of a switching mechanism according to the present invention.

FIG. 3 demonstrates in detail how to construct the switch 201. The switch 201 comprises a current source 211, a NOT-gate 212, a transistor 215, a transistor 210, and a current mirror having a transistor 213 and a transistor 214. The unregulated DC input port $V_{IN}$ is connected to an input of the current source 211 and a source of the transistor 215. An output of the current source 211 is connected to an input of the NOT-gate 212 and to a drain of the transistor 213. A source of the transistor 213 and a source of the transistor 214 are connected to the ground reference. A drain of the transistor 214 is connected to a gate of the transistor 213 and a gate of the transistor 214. The drain of the transistor 214 is also connected to a drain of the transistor 215. A gate of the transistor 215 is connected to the gate signal terminal $V_{GATE}$. An output of the NOT-gate 212 is connected to a gate of the transistor 210. A source of the transistor 210 is connected to the drain of the transistor 200. A drain of the transistor 210 is connected to the feedback terminal $V_{FBAC}$.

The switch 201 is designed to close when the load falls below a switching threshold, and to open when the load exceeds the switching threshold. The current source 211 acts as a bias, and partly determines the switching threshold. The switching threshold is also a function of the physical dimensions of the transistors 213, 214, and 215. The operation of switches is well known to those skilled in the art, and does not need to be discussed in further detail here.

The gate signal terminal $V_{GATE}$ drives the gates of the transistor 200 and the transistor 45. Therefore, the current flowing from the source to the drain of the transistor 45 will be proportional to the current flowing from the source to the drain of the output pass element 10. Likewise, when the switch 201 closes, the current flowing from the source to the drain of the transistor 200 will be proportional to the current flowing from the source to the drain of the output pass element 10. The physical dimensions of the output pass element 10, the transistor 200, and the transistor 45 determine the proportion N, where the current flowing through the output pass element 10 will be N times the sum of the currents flowing through the transistor 200 and the transistor 45. In the LDO regulator according to the present invention, the ratio N is chosen such that the feedback current will not consume any more power than necessary in order to obtain an accurate high-frequency feedback signal. In many practical applications, typical values for N would be 500–1000.

This preferred embodiment of the present invention describes a pole-zero tracking circuit with only one transistor-switch pair connected in parallel to the feedback transistor 45. It is to be understood that the present invention also covers variations to this pole-zero tracking scheme, wherein the pole-zero tracking circuit may consist of an array of transistor-switch pairs connected in parallel to the feedback transistor 45. It is to be understood that the present invention covers such an array of transistor-switch pairs, wherein the transistors may have varying physical characteristics, and the switches may each be biased differently.

Figure 4:
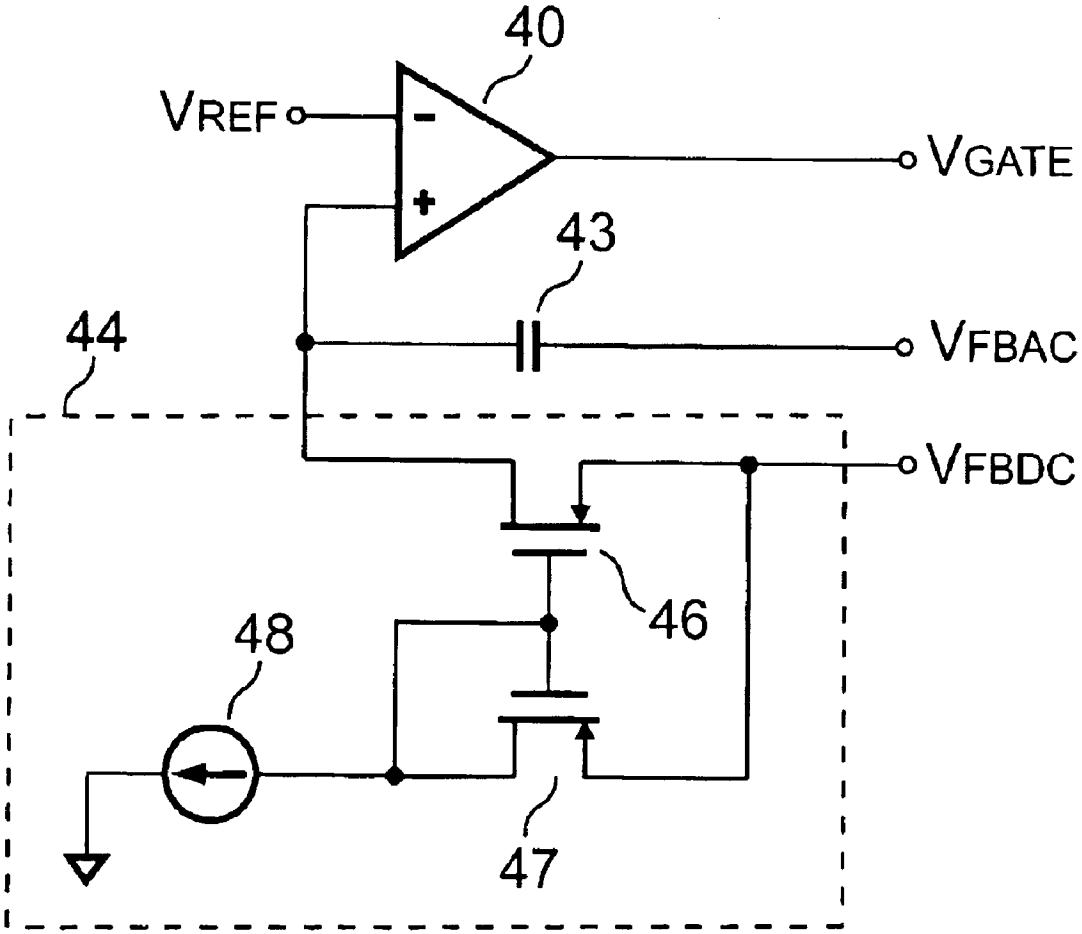
FIG. 4 shows an embodiment of a large resistance of the present invention.

The resistor 44 is required to have a large resistance (10 MΩor more). In practice, such a resistor will be very large, and it would generate excessive amounts of heat. It would not be suitable for use in the power management system of a computer or a mobile phone. FIG. 4 demonstrates in detail how to construct a current mirror that can act as a resistor with a large resistance, for the purposes of the LDO according to the present invention.

The resistor 44 is built from a current source 48, a transistor 46, and a transistor 47. A source of the transistor 46 is connected to the DC feedback terminal $V_{FBDC}$. A drain of the transistor 46 is connected to the positive input of the error amplifier 40. A gate of the transistor 46 is connected to a gate of the transistor 47, a drain of the transistor 47 and an input of the current source 48. A source of the transistor 47 is connected to the DC feedback terminal $V_{FBDC}$. An output of the current source 48 is connected to the ground reference. The current source 48 biases the transistor 46 to operate in linear mode, so that it acts as a resistor. The operation of current mirrors is well known to those skilled in the art, and does not need to be discussed in further detail here.

It is to be understood that the term transistor can refer to a number of devices, including MOSFET, PMOS, and NMOS transistors. Furthermore, the term transistor can refer to any array of transistor devices arranged to act as a single transistor.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims or their equivalents.

What is claimed is:

1. A low drop-out voltage regulator having an adaptive frequency compensation means, comprising:

a regulated DC output terminal;

an unregulated DC input terminal;

an output section having an output capacitor and an output load, wherein said output load is connected from said regulated DC output terminal to the ground reference, and said output capacitor is connected in parallel to a said output load;

an output pass element for supplying power to said output section, wherein said output pass element having a source is coupled to said unregulated DC input terminal, and said output pass element having a drain is connected to said regulated DC output terminal;

a control circuit for controlling a gate of said output pass element;

a stabilizing-zero resistor for generating a zero; wherein said stabilizing-zero resistor generates an additional equivalent series resistance (ESR); and a pole-zero tracking circuit for controlling a frequency of said zero.

2. The low drop-out voltage regulator according to claim 1, wherein said control circuit comprises:

an error amplifier for generating a gate signal, wherein said error amplifier has a negative input connected to a reference voltage port;

an AC feedback terminal for supplying a high-frequency feedback signal to said error amplifier;

a blocking capacitor for blocking DC components from said AC feedback terminal, wherein said blocking capacitor is connected between a positive input of said error amplifier and said AC feedback terminal;

a feedback transistor for supplying a feedback current to said AC feedback terminal, wherein said feedback current is proportional to an output current of the output section, said feedback transistor has a source coupled to the unregulated DC input terminal, and said feedback transistor has a drain coupled to said AC feedback terminal;

a DC feedback terminal for supplying a steady-state feedback signal to said error amplifier, wherein said DC feedback terminal is connected to said regulated DC output terminal; and a large-resistance resistor for maintaining the DC accuracy of the feedback signal, wherein said large-resistance resistor is connected between said DC feedback terminal and the positive input of said error amplifier, and said large-resistance resistor is a device with an equivalent resistance of 10 MΩ or more.

3. The low drop-out voltage regulator according to claim 1, wherein said stabilizing-zero resistor is connected between said regulated DC output terminal and said AC feedback terminal.

4. The low drop-out voltage regulator according to claim 1, wherein said pole-zero tracking circuit comprises:

a switch for modulating the frequency of the zero; and a pole-zero tracking transistor for increasing the throughput of the feedback current, wherein said pole-zero tracking transistor has a source connected the unregulated DC input terminal, and said pole-zero tracking transistor has a drain connected to said AC feedback terminal via said switch.

5. The low drop-out voltage regulator according to claim 1, wherein a frequency of the zero decreases whenever the switch is closed.

6. The low drop-out voltage regulator according to claim 1, wherein a frequency of the zero increases whenever the switch is opened.

7. The low drop-out voltage regulator according to claim 1, wherein a common gate signal is supplied by an output of said error amplifier to said gate of said output pass element, a gate of said feedback transistor, and a gate of said pole-zero tracking transistor.

8. The low drop-out voltage regulator according to claim 1, wherein said feedback transistor, said pole-zero transistor, and said output pass element are arranged such that for a given gate voltage, the output current from said source of said output pass element is at least 500 times greater than the sum of the output currents from said source of said feedback transistor and said source of the pole-zero tracking transistor.

9. The low drop-out voltage regulator according to claim 4, wherein said switch comprises:

a first current source for providing a bias to said switch, wherein said first current source has an input connected to said unregulated DC input terminal;

a NOT-gate having an input connected to an output of said first current source;

a first transistor having a gate connected to said common gate signal terminal, wherein said first transistor has a source connected to said unregulated DC input terminal;

a first current mirror having a second transistor and a third transistor, wherein said first current mirror is coupled to the output of said first current source and said first transistor; and a fourth transistor for opening and closing said switch, wherein said fourth transistor has a gate connected to an output of said NOT-gate, said fourth transistor has a source connected to the drain of said pole-zero tracking transistor, and said fourth transistor has a drain connected to said AC feedback terminal.

10. The low drop-out voltage regulator according to claim 4, wherein said switch has a current threshold, wherein said switch opens whenever the current through said switch exceeds said current threshold, and said switch closes whenever the current through said switch decreases below said current threshold.

11. The low drop-out voltage regulator according to claim 2, wherein said large-resistance resistor comprises:

a second current source for providing a bias to said large-resistance resistor, wherein said second current source has an output connected to the ground reference; and a second current mirror having a fifth transistor and a sixth transistor, wherein said second current mirror is coupled to an input of said second current source, said second current mirror has a source of the fifth transistor and a source of the sixth transistor connected to said DC feedback terminal, and said second current mirror has a drain of said fifth transistor connected to the positive input of said error amplifier.

12. The low dropout voltage regulator according to claim 1, wherein said low voltage drop-out regulator is stable for any parasitic ESR of the output section less than 50 mΩ.

13. A method of circuit operation in a low drop-out voltage regulator comprising:

accepting a reference voltage at an error amplifier, an output of said error amplifier supplying a common gate signal;

controlling a first transistor by means of the common gate signal to produce an output signal at an output terminal of the voltage regulator from an unregulated input voltage;

controlling a second transistor by means of the common gate signal to supply a high-frequency feedback signal from the unregulated input voltage to an input of said error amplifier;

controlling a third transistor by means of the common gate signal to supply an additional high-frequency feedback signal from the unregulated input voltage via a switch to said input of said error amplifier;

introducing a zero into the transfer function of the voltage regulator by means of a stabilizing-zero resistor, such that the circuit will be stable when the ESR of an output capacitor of the voltage regulator is lower than 50 mΩ;

varying a frequency of said zero based on a load current value of the output signal generated at said output terminal of the voltage regulator, wherein said switch opens and closes in response to changes in the magnitude of the load current value;

supplying the output signal of the power supply to the input of said error amplifier via a large-resistance resistor, wherein a resistance of said large-resistance resistor is at least 10 MΩ; and modulating the common gate signal based on the sum of the high-frequency feedback signals and the output signal supplied to said error amplifier.

14. The method of circuit operation in a low drop-out voltage regulator according to claim 13, wherein said third transistor can be replaced by an array of transistors, wherein each transistor in the array is controlled by the common gate signal, wherein each transistor in the array supplies an additional high-frequency feedback signal from the unregulated input voltage via a switch to the input of the error amplifier, and wherein each switch can have a different output current threshold for opening and closing.

15. The method of circuit operation in a low drop-out voltage regulator according to claim 13, wherein for a given gate voltage, the output current of said first transistor is at least 500 times greater than the sum of the output currents of all other transistors coupled to the unregulated input voltage.

* * * * *